United States Patent [19]

Cahuzac

[11] Patent Number: 4,848,414

[45] Date of Patent: Jul. 18, 1989

[54] WOVEN REINFORCEMENT FOR A COMPOSITE MATERIAL

[75] Inventor: Georges J. Joseph Cahuzac, Saint Jean D'Illac, France

[73] Assignee: Aerospatiale Societe Nationale Industrielle, France

[21] Appl. No.: 157,325

[22] Filed: Feb. 17, 1988

[30] Foreign Application Priority Data

Feb. 17, 1987 [FR] France ..... 87 02012

[51] Int. Cl.[4] ..... D03D 11/00

[52] U.S. Cl. ..... 139/411

[58] Field of Search ..... 139/408, 409, 410, 411, 139/412, 413, 414, 415

[56] References Cited

U.S. PATENT DOCUMENTS

| | | | |
|---|---|---|---|
| 2,866,483 | 12/1958 | Watts et al. | 139/412 |
| 4,174,739 | 11/1979 | Rasero et al. | 139/408 |
| 4,312,913 | 1/1982 | Rheaume | 139/408 |

*Primary Examiner*—Henry S. Jaudon

*Attorney, Agent, or Firm*—McGlew & Tuttle

[57] ABSTRACT

This reinforcement is formed by a basic pattern constituted by fifteen woof threads R in a staggered arrangement forming six vertical columns 1 to 6 of alternately two and three threads and at least five horizontal lines 1 to 5 each of three threads, and by six imbricated layers C1 to C6 of at least two parallel threads, namely at least twelve threads a, b, c . . . 1, each connecting every third woof thread of the same column in two adjacent lines and the warp threads of the consecutive layers connecting the woof threads in alternating columns.

2 Claims, 4 Drawing Sheets

WOVEN REINFORCEMENT FOR A COMPOSITE MATERIAL

The present invention relates to composite materials and more particularly concerns a woven reinforcement having a new texture for manufacturing parts having a very high strength.

Composite materials generally present the following two advantages:

Characteristics, and in particular mechanical characteristics, which are exceptional.

Remarkable aptitudes to orient the constituents in the directions of the stresses to which the structure is subjected, so that the latter has unequalled characteristics.

Composite materials are constituted by a reinforcement and a binder. The reinforcement is essentially produced from very strong textile filaments (filaments of glass, silica, carbon, silicon carbide, alumina, aromatic polyamide, etc.) and the binder may be an organic resin, a refractory product or a metal.

An object of the present invention is to produce a new type of reinforcement. As constructed in accordance with the invention, the armature is said to be woven. Woven reinforcement is intended to mean an interlacing of textile yarns or threads which is self-maintained and has the dimensional characteristics of the part of composite material.

The binder required for the finishing of the structure may be deposited in the woven reinforcement by either a liquid method or a gas method. The liquid method consists in causing an impregnating liquid to penetrate the reinforcement, this liquid being converted by a subsequent treatment so that the structure formed in this way has the required characteristics. The gas method is intended to mean a process which is such that the reinforcement is placed in an enclosure at fixed temperature and pressure and is subjected in concomitant manner to a gas flow, the molecules of which are decomposed on contact with the filaments forming the reinforcement (chemical deposit in a vapor phase). At the end of a certain period of time, the reinforcement plus the binder have obtained the required characteristics.

Technical literature describes reinforcements comprising strengthening in different directions:

Reinforcements With a Fibrous Strengthening in Random Directions (Termed Random D)

This is in particular the case of felts. These reinforcements have the advantage of very homogeneous characteristics. They have the often unacceptable drawback of having low mechanical characteristics owing to the fact that the fibers are short (less than one centimeter) and poorly interconnected by the binder.

Reinforcements Having a Fibrous Strengthening in One Direction (Termed 1D)

Reinforcements of this type are mostly employed as by-products of reinforcements having more than one direction (except for the random Ds) or in the sport and recreation industry. They are formed by long fibers (several meters) which are aligned in parallel relation to one another.

Reinforcements Having Fibrous Strengthening in Two Directions (Termed 2D)

This concerns all kinds of fabrics and wound products. These fabrics are employed in the single layer state mainly in the clothing industry. In most other industries, the 2Ds are employed in the multi-layer state. The resulting structures have excellent mechanical characteristics in the direction of the strengthenings. On the other hand, in the perpendicular direction, the characteristics are very low so that inter-layer cleaving (also termed delamination) may occur during the depositio of the binder when a shock or cyclic stresses occur which are often unacceptable for the envisage utilization.

Reinforcements Having a Fibrous Strengthening in Three Directions (Termed 3D)

This concerns much more sophisticated products, the use of which is essentially reserved at the present time for aeronautical or ballistic fields. The resulting structures have excellent characteristics, in particular in the three directions of the strengthening threads. Moreover, there is no risk of delamination.

The strengthening threads may be disposed either along the three axes of a normal trihedron (triorthogonal 3D), or along radial, circumferential and longitudinal directions of the axisymmetrical parts (polar 3D).

The drawback of 3D reinforcements is that, as obtained by the existing processes, the spacing between the layer of the threads is too large to satisfy the needs of thin structures, which may be on the order of 1 to 3 mm. Moreover, owing to its geometrical construction, the 3D has large cavities. The latter most often complicate the operation of the deposition of the binder in a homogeneous manner, in both the liquid method and the gas method.

Many processes exist for producing fibrous reinforcements. Some of these processes are in the public domain; others are protected by patents, for example U.S. Pat. Nos. 4,183,232, 4,346,741, 4,644,619 and 4,656,703 of the applicant.

Other reinforcements having more than three dimensions exist (4D, 5D, 9D and 11D). They have the advantage of good homogeneous characteristics. However, their use is very marginal, in particular owing to the extreme complexity of their production by automatic processes.

An object of the invention is to provide a novel reinforcement which is particularly appropriate for the realization of thin structures and in particular for elements protecting spacecraft when they re-enter the atmosphere, or other applications having very high mechanical characteristics in the direction of the strengthenings, equivalent to a stacking of 2D, lamination free as a 3D, but without threads perpendicular to the wall, i.e., a reinforcement between 2D and 3D.

The invention therefore provides a reinforcement of woven threads or yarns formed by woof threads and warp threads, wherein its texture is formed by a basic pattern constituted by fifteen woof threads R disposed in staggered relation forming six vertical columns 1 to 6 of alternately two and three threads and at least five horizontal lines 1 to 5 each having three threads, and by six imbricated layers C1 to C6 of at least two parallel threads, namely at least twelve threads a, b, c ... 1, each connecting every third woof thread of the same column in two adjacent lines and the warp threads of the consecutive layers connecting woof threads in alternating columns, the first thread a of the first layer $C1_2$ connecting the woof thread R of column 2, in line 1, namely $R_1$ to the woof thread R of column 5 in line 2, namely $R_2^5$, the secoond thread b of the first layer C1 connecting the woof thread R of column 2, in line 3, namely $R_3^2$, to the woof thread R of column 5, in line 4, namely $R_4^5$; the first thread c of the second layer C2 connecting the woof thread R in line 2, namely $R_2^1$, to the woof thread R or column 4, in line 1, namely $R_1^4$; the second thread d of the second layer C2 likewise connectign the warp threads $R_4^4$ and $R_3^4$, the paths of the threads of the following layers C3, ... C6 being obtained by adding 2 to each preceding corresponding column reference, namely, for the first thread of the layer C3 $=R_2^{1+2}=R_2^3$ and $R_1^{4+2}=R_1^6$, etc., this pattern being capable of being enlarged in the direction of the thickness of the material to be produced with an odd number of lines.

FIG. 4 is an example of the enlargement of the basic pattern comprising seven lines and layers of three threads.

The following description with reference to the accompanying drawings given by way of non-limitative examples will explain how the invention can be put into practice.

The principle of the reinforcement 1,5D resides in the interlacing of the warp threads and the woof threads to obtain a lamination-free material with no thread perpendicular to the wall.

Figure 1:
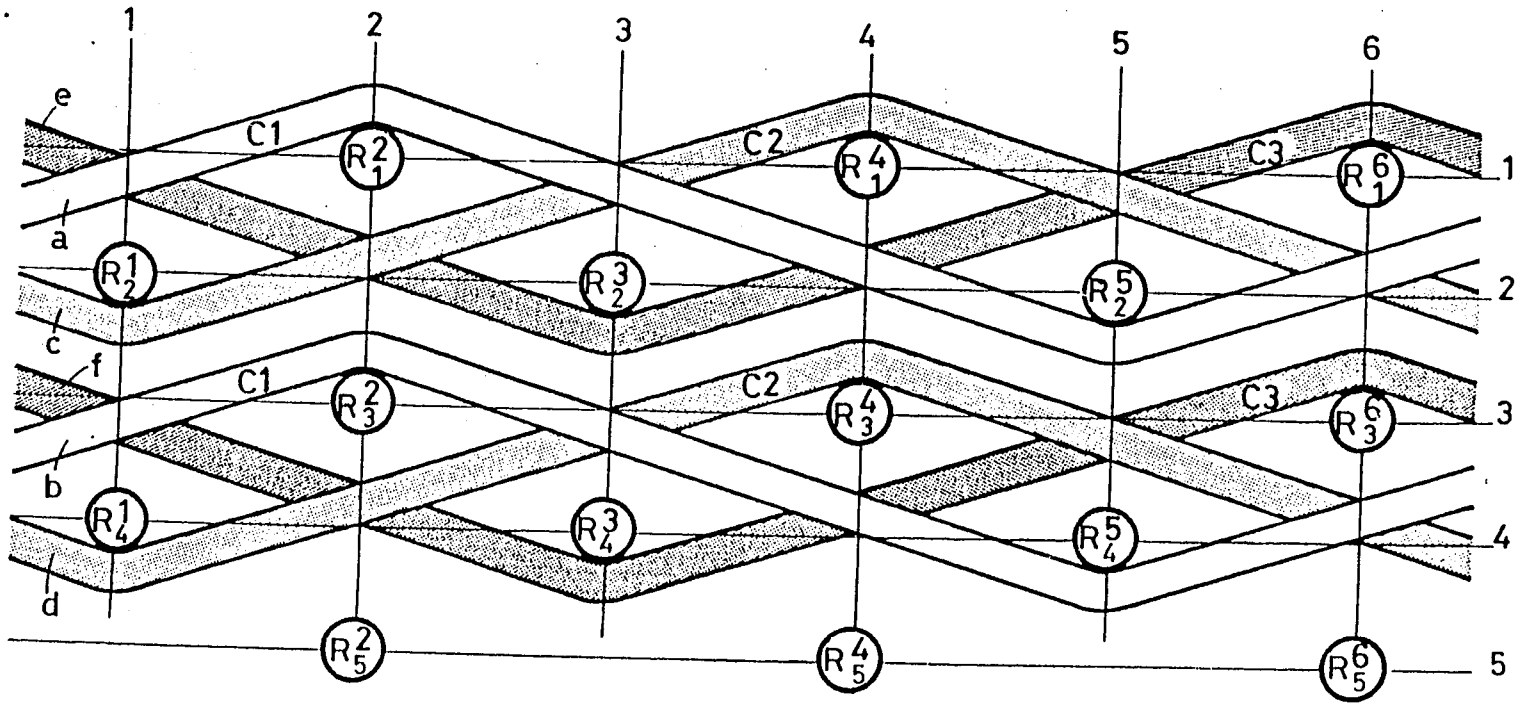
FIG. 1 is a diagrammatic view of a first part of a basic pattern of a reinforcement according to the invention showing the arrangements of six warp threads a ... f of three first layers C1, C2, C3 relative to the woof threads R.
Figure 2:
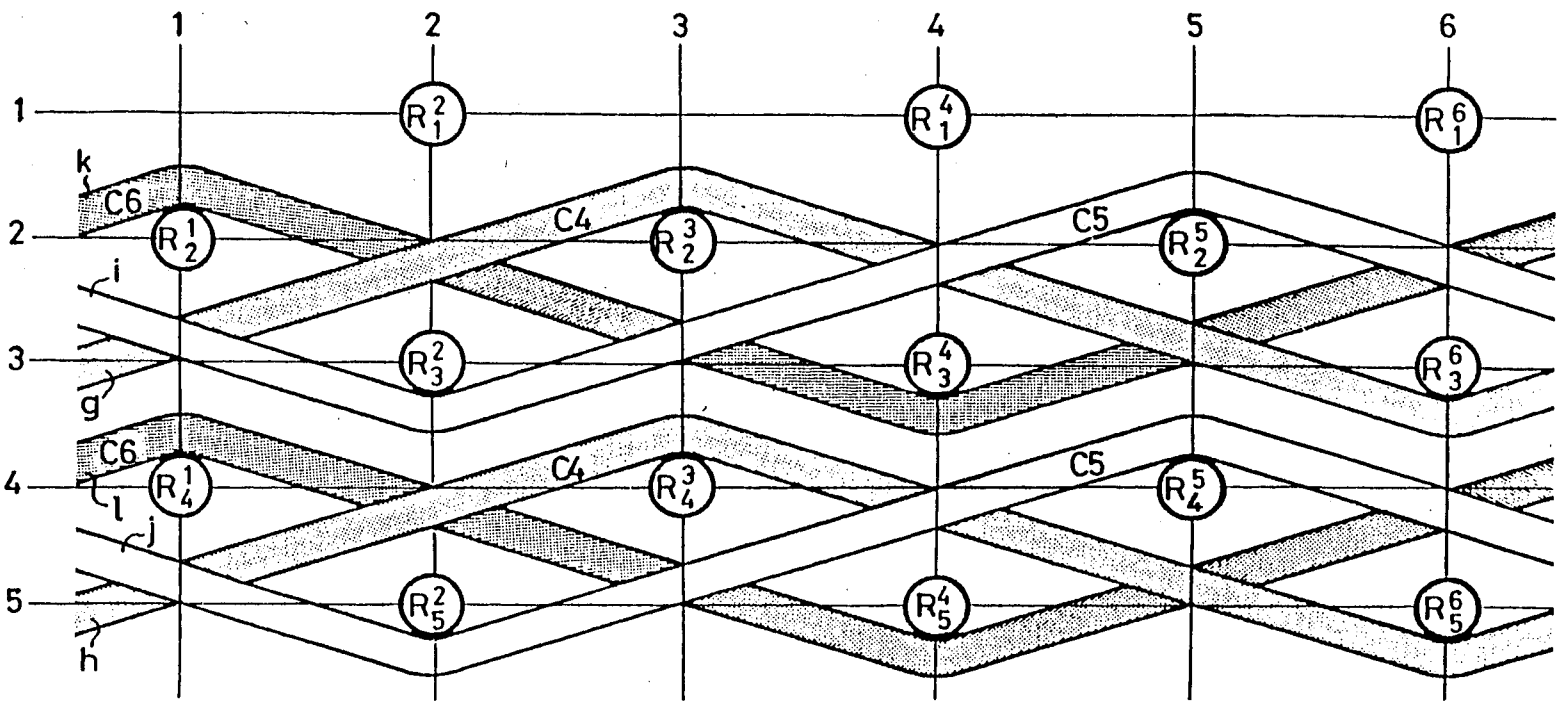
FIG. 2 is a view similar to that of FIG. 1 showing the arrangement of six warp threads g ... 1 of three other layers C4, C5, C6 relative to the woof threads of the same basic pattern.
Figure 3:
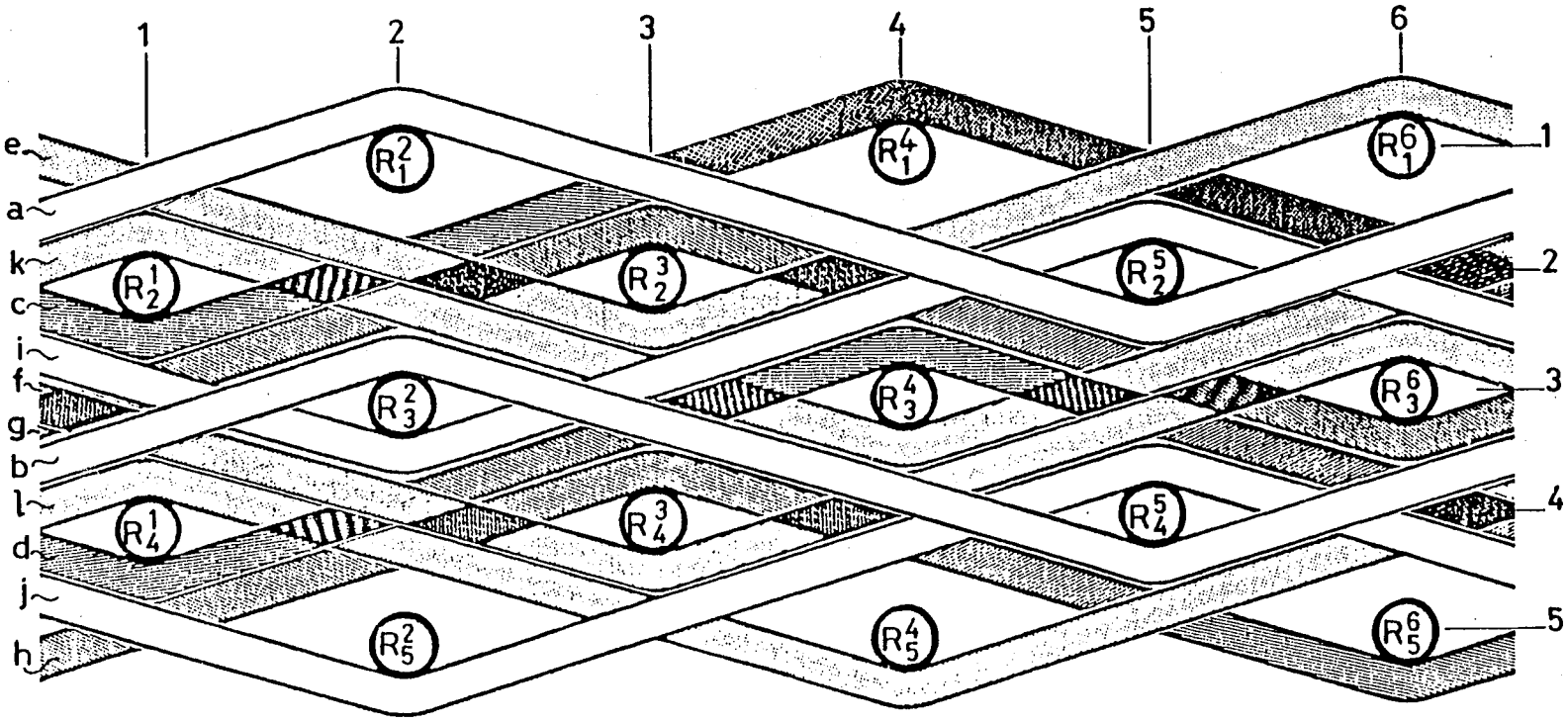
FIG. 3 is a diagrammatic view of a complete basic pattern obtained by superimposition of FIGS. 1 and 2.
Figure 4:
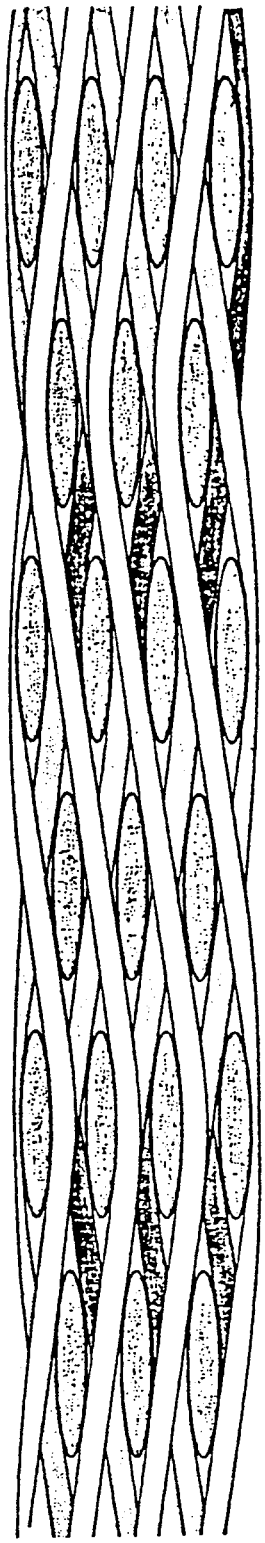
FIG. 4 shows the actual arrangement of the warp and woof threads in the reinforcement according to the invention as it appears in micrography.

FIGS. 1 to 3 show how the warp threads are disposed relative to the "circles" which correspond to the position of the woof threads. It will be observed that these woof threads, or these "circles" are disposed in staggered relation and form alignments in lines and columns every other intersection of which has a "circle" if each "circle" is given a line number and a column number: $R_3^2$ designates the "circle" of the second column and third line. It will be observed that the total number of lines depends on the thickness of the material to be produced and that it is odd (here 5) whereas the number of columns is a multiple of 6 since the remainder of the reinforcement is obtained by repetition of the preceding pattern.

A group of pairs of parallel threads will be termed "layer". A complete pattern is formed by six layers of warp threads which are parallel in pairs.

These layers will be designated by C1, C2, C3, C4, C5 and C6. (For reasons of clarity, the path of these layers has been divided into two figures.) FIG. 1 shows the path of the layers C1, C2 and C3 and FIG. 2 shows the path of the layers C4, C5 and C6.

In the illustrated pattern, the layer has only two threads and the number of threads of a layer is equal to one-half of the even number immediately lower than the number of lines.

The first thread of the layer C1 passes over $R_2^1$, $R_{1hu}$ 2, $R_2^3$ and under $R_1^4$, $R_2^5$ and $R_1^6$.

The second thread of the layer C1 passes over $R_4^1$, $R_3$, $R_3^2$, $R_4^3$ and under $R_3^4$, $R_4^5$ and $R_3^6$.

The first thread turns around $R_1^2$, then $R_2^5$. It consequently connects every third woof thread of line 1 to every third woof thread of line 2.

The second thread turns around $R_3^2$, then $R_4^5$. It consequently connects every third woof thread of line 3 to every third woof thread of line 4.

By adding 2 to the column number of the woof threads, the path of the threads of layer C2 is obtained and by again adding 2 thereto, the path of the layer C3 is obtained.

When these three layers have passed, the woof threads of line 1 are connected to those of line 2 and the woof threads of line 3 to those of line 4.

The layers C4, C5 and C6 (FIG. 2) connect the woof threads of line 2 to those of line 3 and the woof threads of line 4 to those of line 5.

The path of C4 is deduced from that of layer C1 by adding 1 to the line number and 1 to the column number of the woof threads.

The actual appearance of the product obtained is represented in FIG. 3. The flattened oval shape taken on by the woof threads and the high percentage of the area occupied by the filaments will be observed; this has a favorable action on the mechanical behavior of the material and facilitates the application of the binder.

The pattern constituting this reinforcement is the simplest and the most logical for obtaining a material having interlaced layers.

Each warp thread connects two rows of adjacent woof threads. The staggered arrangement of the woof threads (R) is required for avoiding a gap between the warp threads and minimizing the undulations of the warp threads.

In this pattern, six thread layers are required for connecting the woof threads of the thread rows.

The reinforcements according to the invention may be realized with threads of any type (carbon, Kevlar, silica, silicon carbide, Nextel ...).

These reinforcements are realized with threads which are either of the same type or by a combination of threads of different types. Moreover, the sections of the threads may be identical or have different dimensions and shapes.

The meshing of the reinforcement may be adapted to requirements by a prior arrangement of the "circles" corresponding to the woof threads.

The reinforcement according to the invention may be produced in the form of a plate. However, the major part of this type of product concerns circular parts of variable shape and is particularly suitable for thin structures.

What is claimed is:

1. A reinforcement comprising woven threads formed by woof threads and warp threads, wherein the texture of the reinforcement is formed by a basic pattern comprising (1) fifteen woof threads R arranged in staggered relation, forming (a) six vertical columns 1 to 6 of laternately two and three threads and (b) at least five horizontal lines 1 to 5 each having three threads, and (2) six layers Ci to C6 of at least two parallel threads, namely at least twelve threads a,b,c,d,e,f,g,h,i,j,k,l, the threads of each layer connecting every third woof thread of the same column in two adjacent lines and the warp threads of the consecutive layers connecting woof threads in alternating columns; the first thread a of the first layer C1 connecting the woof thread R of column 2, in line 1, namely $R_1^2$, to the woof thread R of column 5 in line 2, namely $R_2^5$; the second thread b of the first layer C1 connecting the woof thread R of column 2 in line 3, namely $R_3^2$, to the woof thread R of column 5 in line 4, namely $R_4^5$; the first thread c of the second layer C2 connecting the woof thread R of column 1 in line 2, namely $R_2^1$, to the woof thread R of column 4 in line 1, namely $R_1^4$; the second thread d of the second layer C2 likewise connecting the woof threads $R_4^1$ and $R_3^4$, the paths of the threads of the following layers C3, C4, C5, C6 being obtained by adding two to each preceding corresponding column reference, namely, for the first thread layer C3 $=R_2^{1+2}=R_2^3$ and $R_1^{4+2}=R_6^1$, and so on.

2. A reinforcement according to claim 1, in which the basic pattern is enlarged in the direction of the thickness of the material by the addition of increments of an even number of lines, each increment consisting of six woof threads.

* * * * *